United States Patent [19]

White

[11] 4,192,101

[45] Mar. 11, 1980

[54] DOOR SEALING APPARATUS

[76] Inventor: William G. White, 12 Winthrop La., Holden, Mass. 01520

[21] Appl. No.: 918,383

[22] Filed: Jun. 23, 1978

[51] Int. Cl.[2] ..... E06B 7/16

[52] U.S. Cl. ..... 49/478; 49/470

[58] Field of Search ..... 49/478, 470

[56] References Cited

U.S. PATENT DOCUMENTS

| | | | |
|---|---|---|---|
| 3,353,301 | 11/1967 | Heilweil et al. | 49/478 X |
| 3,512,304 | 5/1970 | Meuret | 49/478 X |
| 3,604,152 | 9/1971 | Protzman | 49/478 X |

FOREIGN PATENT DOCUMENTS

| | | | |
|---|---|---|---|
| 1234758 | 6/1971 | United Kingdom | 49/470 |

*Primary Examiner*—Kenneth Downey

*Attorney, Agent, or Firm*—Norman S. Blodgett; Gerry A. Blodgett

[57] ABSTRACT

Apparatus for sealing a door including a metal strip to be applied to the door and a sealing strip having a magnetic portion for application to the frame.

4 Claims, 6 Drawing Figures

DOOR SEALING APPARATUS

BACKGROUND OF THE INVENTION

One of the outstanding problems in house construction is that of preventing the leakage of warm air from the interior of the house around the space between a door and its frame. For many years, the method of accomplishing this was by the use of the so-called "weather stripping" in which a mechanical interlock was arranged between an element on the door and an element on the frame. Such devices were complex in nature, as well as difficult and expensive to apply to the door, since special rabbets had to be formed on the door to permit the installation. In the recent past, it has been found that air-tight seals for refrigerators can be provided by the use of a resilient element in which is embedded a permanent magnet. Such structures not only hold the refrigerator door in closed position, but provide an excellent air-tight seal. Many manufacturers, therefore, have adapted this system to the provision of sealing for house doors, but the units have been applied to the door and frame in the factory and the door and frame have been sold as a unit, the door usually being made of steel. Doors and frames made this way are very expensive, of course, and this apparatus does not lend itself to application to existing doors and frames, particularly those made of wood. The reason that the magnetic seals lend themselves well to the steel door and frame is because these elements do not change their geometric relationship to each other with time. In the case of wooden doors and frames, however, the weather and moisture causes the wood to swell and warp, so that the edge relationships of the doors and frames change from time-to-time. These and other difficulties experienced with the prior art devices have been obviated in a novel manner by the present invention.

It is, therefore, an outstanding object of the invention to provide apparatus for providing a seal between the edge of a door and the frame, wherein the apparatus can be readily applied after the house has been completed.

Another object of this invention is the provision of a sealing apparatus for a door and frame that can be applied without removing the door from its hinges.

A further object of the present invention is the provison of a door sealing apparatus which can be attached to a door by a person of moderate skill without the use of complex tools.

It is another object of the instant invention to provide a sealing apparatus for a door and its frame in which no modification of the door or frame is necessary.

A still further object of the invention is the provision of a sealing apparatus for a door in which the apparatus is capable of being supplied in the form of a kit that can be cut and applied by unskilled labor.

It is a further object of the invention to provide a door sealing apparatus which retains its sealing ability despite geometric changes in the door and frame due to warping and the like.

It is a still further object of the present invention to provide a door sealing apparatus of such a nature that it can be inexpensively manufactured by mass production methods, thus assuring extensive use in energy-saving applications.

Another object of the invention is the provision of a door sealing apparatus which can be exposed to extreme changes of temperature and of moisture without deterioration.

With these and other objects in view, as will be apparent to those skilled in the art, the invention resides in the combination of parts set forth in the specification and covered by the claims appended hereto.

SUMMARY OF THE INVENTION

In general, the invention consists of apparatus for sealing a door against leakage, which apparatus consists of a thin metal strip extending around the periphery of the door on a face surface. A sealing strip is mounted on the frame and includes a base portion attached to the frame, a resilient collapsible portion extending from the base portion, and a magnetic portion extending from the collapsible portion.

More specifically, the sealing strip consists of an integral extrusion of an elastomer in which the collapsible portion is formed as a hollow bellows and in which a permanent magnet is molded in the magnetic portion. The base portion consists of a hollow extrusion having at least one flat outer surface for broad engagement with the surface of the frame. Along the bottom edge of the door the metal strip is applied to the threshold, while the sealing strip is carried by the door.

BRIEF DESCRIPTION OF THE DRAWINGS

The character of the invention, however, may be best understood by reference to one of its structural forms, as illustrated by the accompanying drawings in which.

DESCRIPTION OF THE PREFERRED EMBODIMENT

Figure 1:
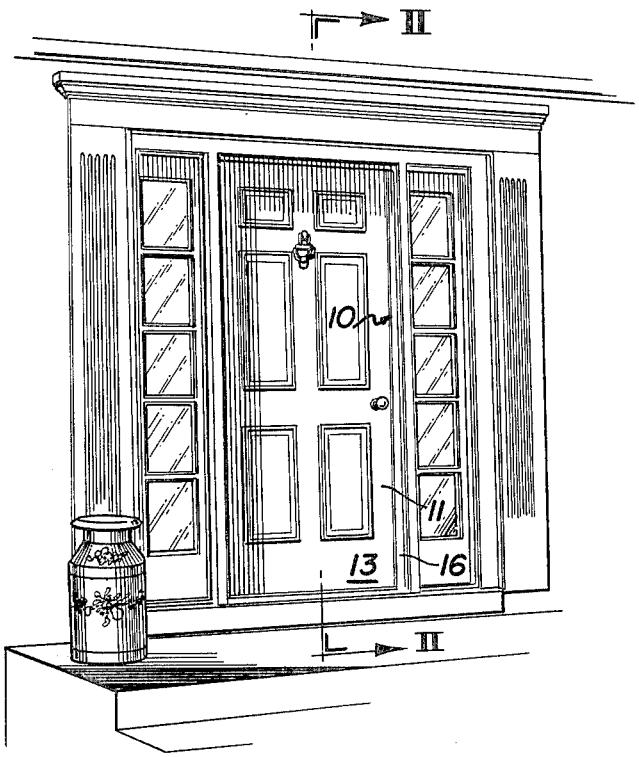
FIG. 1 is a perspective view showing sealing apparatus embodying the principles of the present invention in use with a door and frame.

Referring first to FIG. 1, wherein are best shown the general features of the invention, the door sealing apparatus, designated generally by the reference numeral 10, is shown in use with a door 11 having an outwardly-facing surface 13 and mounted in a frame 16.

Figure 2:
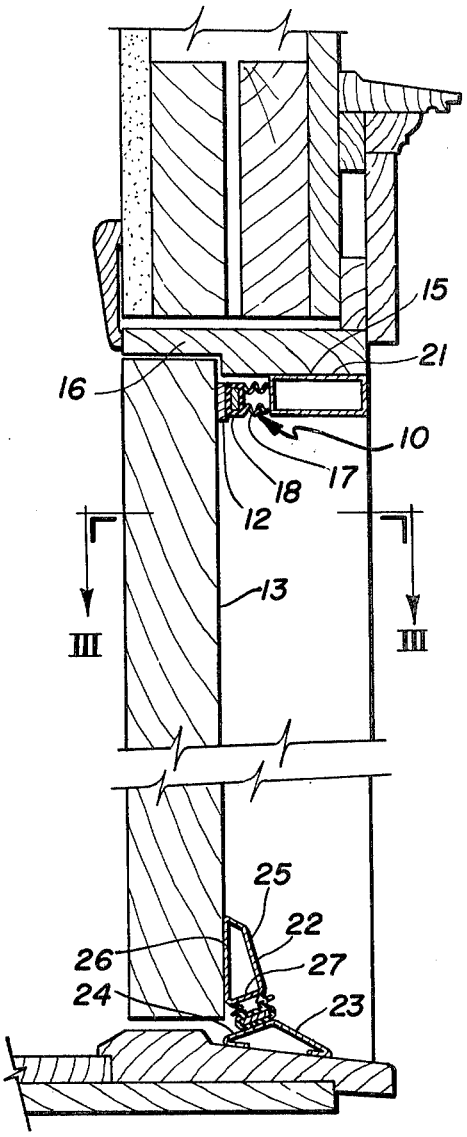
FIG. 2 is a vertical sectional view of the apparatus taken on the line II—II of FIG. 1.

Referring to FIG. 2 it can be seen that the apparatus 10 consists in part of a thin ferrous metal strip 12 carried on the face 13 of the door along its periphery. In the preferred embodiment, the strip is attached to the surface of the door by use of a pressure-sensitive adhesive. The apparatus also includes a sealing strip 14 fastened to the frame along those surfaces that extend at right angles to the face 13 of the door. The sealing strip consists of a base portion 15 which is directly attached to the frame, of an intermediate portion in the form of a resilient collapsible portion 17 extending away from the base portion, and, finally, of a magnetic portion 18 extending away from the collapsible portion and having a permanent magnetic bar 19 molded in it.

Figure 5:
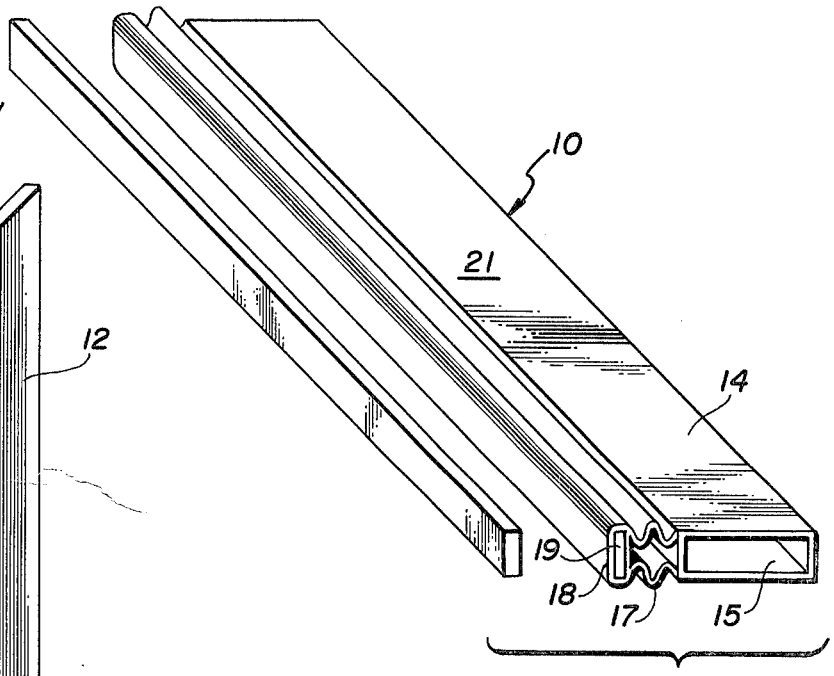
FIG. 5 is a perspective view of the form of the apparatus that is applied to the upper horizontal edge of the door.

Referring to FIG. 5 it can be seen that the sealing strip 14 consists of an integral extrusion of a polymer, such as polyvinyl chloride, in which the collapsible portion 17 is formed as a hollow bellows and the permanent magnetic bar 18 is molded in the magnetic portion. The base portion 15 consists of a hollow extrusion of a polymer having at least one flat outer surface 21 for broad engagement and fastening to the surface of the frame 16.

Figure 4:
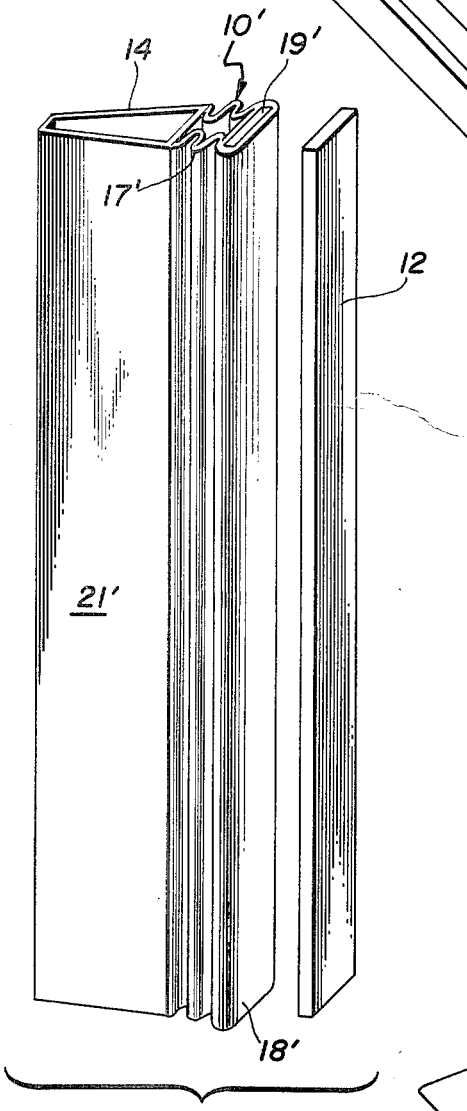
FIG. 4 is a perspective view of the form of the apparatus that is applied along the vertical edges of the door.

In FIG. 4 the sealing strip 14' also consists of an integral extrusion of a polymer in which the collapsible portion 17' is formed as a hollow bellows. The permanent magnet 19' is also molded in magnetic portion 18'. The base portion 15' flat outer surface 21 for broad engagement with and fastening to the surface of the frame.

Figure 6:
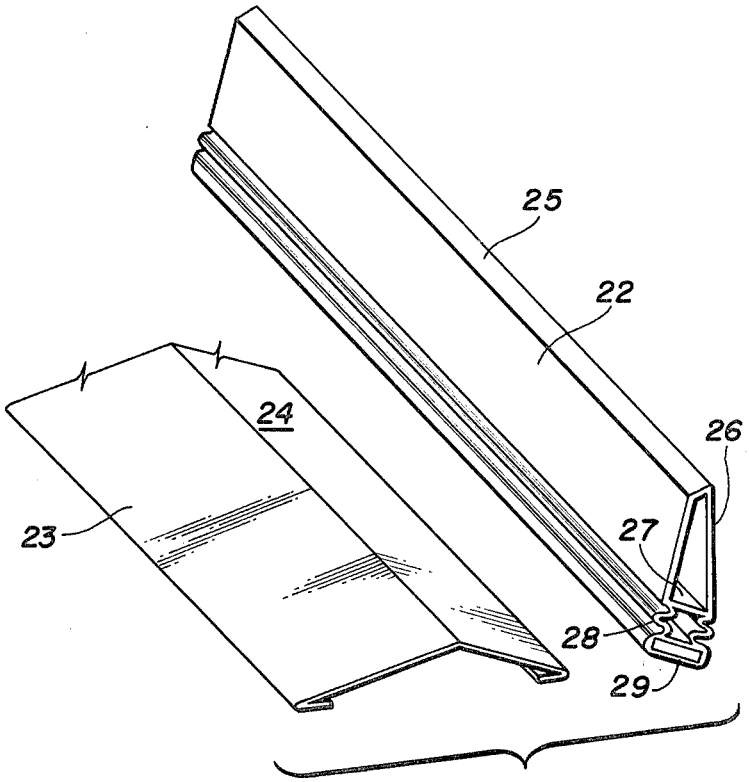
FIG. 6 is a perspective view of the form of the apparatus used at the bottom edge of the door.

In FIG. 6 it can be seen that along the bottom edge of the door 11, the second sealing strip 22 is mounted on the face 13 of the door and a second metal strip 23 is mounted on the threshold. The second metal strip includes an inclined surface 24 that faces in the direction of the opening of the door and the magnetic portion 29 of the second sealing strip 22 is also inclined, so that its contact surface is generally parallel to the said inclined surface 24.

The base portion 25 of the second sealing strip is a hollow extrusion that has a broad surface 26 for attachment to the vertical face of the door and a wall 27 that extends at an acute angle thereto in order to hold a collapsible portion 28 and the magnetic portion 29 at an appropriate angle to contact the said inclined surface 24 of the second metal strip 23 as the door is closed.

Figure 3:
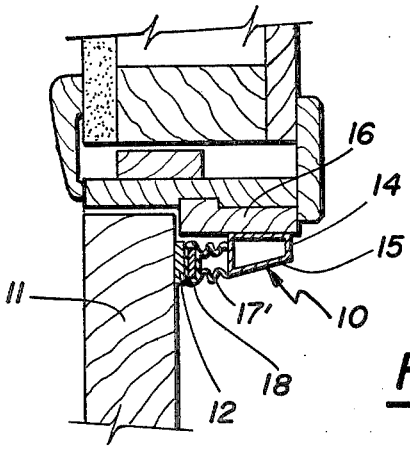
FIG. 3 is a horizontal sectional view of the apparatus taken on the line III—III of FIG. 2.

As is evident in FIGS. 3 and 4, the base portion 15' of the sealing strip 14' (which extends along both sides of the door) is of a generally-tapered conformation, particularly for the sake of appearance.

The operation and advantages of the present invention will now be readily understood in view of the above description. The present apparatus is intended to be applied to a door 11 and its frame 16 that is already installed in a residence. The metal strip 12 is applied along the periphery of the door 13, but only along the top edge and the side edges. The strip is delivered with one side coated with a pressure-sensitive adhesive covered by a protective layer. The protective layer must be removed before the strip is applied. The sealing strip 14 along the top edge and the sealing strip 14' along the side edges may be applied in the same way, that is to say, but the use of pressure-sensitive adhesive. Similarly, it is possible to attach the second metal strip along the threshold by the use of pressure sensitive adhesive and the second sealing strip 22 is applied in the same manner. In each case, the sealing strip has a broad surface that can be attached in this way, namely, the surface 21 in the case of the sealing strip 14, the surface 21' in the case of the sealing strip 14', and the surface 26 in the case of the second sealing strip 22.

Preferably, the sealing strips 14, 14', and 22 are applied in such a way that their edges form an uninterrupted frame around the door. The best way to accomplish this is to have the lower edge of the magnetic portion 18 engage the upper ends of the magnetic portions 18'. At the lower end the inner side edges of the two magnetic portions 18' of the side sealing strips engage the ends of the magnetic portion 29 of the bottom sealing strip 22. This arrangement allows for the variation in size and geometric relationship of the frame 16 and the door 11, compensation being taken care of by the bellows shape of the bellows or collapsible portion 17, 17', and 28 of the sealing strips.

It can be seen, then, that the present invention has a number of advantages. It provides a much tighter seal than any other commercially available weather stripping system. It can be easily installed on any existing door and can be used on doors made of wood, metal, composition plastic, etc. The weather stripping efficiency is not effected by normal settlement of the building. Furthermore, its efficiency is not effected by expansion or contraction of the door due to humidity, heat, and cold, etc. The apparatus requires no maintenance or adjustment (once it has been installed) and it does not interfere with the closing of the door either at the lock side or at the hinge side.

It is obvious that minor changes may be made in the form and construction of the invention without departing from the material spirit thereof. It is not, however, desired to confine the invention the exact form herein shown and described, but it is desired to include all such as properly come within the scope claimed.

The invention having been thus described, what is claimed as new and desired to secure by Letters Patent is:

1. Apparatus for sealing a door against leakage comprising:

(a) a first thin metal strip extending around the periphery of the door on the face surface, (b) a first sealing strip mounted around the frame, including a base portion attached to the frame, a resilient collapsible portion extending from the base portion, and a magnetic portion extending from the collapsible portion, (c) a second metal strip mounted on the threshold including an inclined surface that faces in the direction of the opening of the door, and (d) a second sealing strip having a base portion attached to the face of the door adjacent the bottom edge, a resilient collapsible portion extending from the base portion, and a magnetic portion extending from the collapsible portion, said magnetic portion having a contact surface that is generally parallel to the inclined surface of the second metal strip.

2. Apparatus as recited in claim 1, wherein the base portion of the second sealing strip is a hollow extrusion that has a broad surface for attachment to the vertical face of the door and a wall that extends at an acute angle thereto to hold the collapsible portion and the magnetic portion at the appropriate angle to contact the said inclined surface of the second metal strip as the door is closed.

3. Apparatus as recited in claim 1, wherein each of the sealing strips consists of an integral extrusion of a polymer in which the collapsible portion is formed as a hollow bellows, and wherein a permanent magnetic bar is molded in the magnetic portion.

4. Apparatus as recited in claim 1, wherein the base portion of each sealing strip consists of a hollow extrusion of a polymer having at least one flat outer surface for broad engagement with and fastening to the surface of the frame.

* * * * *